US008727068B2

(12) United States Patent
Bruin

(10) Patent No.: US 8,727,068 B2
(45) Date of Patent: May 20, 2014

(54) SOUND-DAMPING HOUSING FOR A PUMP AND FOR A DRIVE MOTOR FOR SAID PUMP

(75) Inventor: Johannes Bruin, Apeldoorn (NL)

(73) Assignee: B.B.A. Participaties B.V., Klarenbeek (NL)

( * ) Notice: Subject to any disclaimer, the term of this patent is extended or adjusted under 35 U.S.C. 154(b) by 1134 days.

(21) Appl. No.: 12/668,273

(22) PCT Filed: Jun. 23, 2008

(86) PCT No.: PCT/NL2008/050418

§ 371 (c)(1),
(2), (4) Date: Jun. 2, 2011

(87) PCT Pub. No.: WO2009/008712

PCT Pub. Date: Jan. 15, 2009

(65) Prior Publication Data

US 2011/0290582 A1 Dec. 1, 2011

(30) Foreign Application Priority Data

Jul. 12, 2007 (NL) ..... 1034120

(51) Int. Cl.

| | |
|---|---|
| ***G10K 11/00*** | (2006.01) |
| ***F02B 77/13*** | (2006.01) |
| ***B60K 1/00*** | (2006.01) |
| ***B60K 5/00*** | (2006.01) |
| ***B60K 13/04*** | (2006.01) |

(52) U.S. Cl.
USPC ..... 181/200; 181/204; 180/294; 180/296; 123/198 E

(58) Field of Classification Search
USPC ..... 181/200, 204; 180/294, 296; 123/198 E
See application file for complete search history.

(56) References Cited

U.S. PATENT DOCUMENTS

| | | | | |
|---|---|---|---|---|
| 2,613,754 | A * | 10/1952 | Van Doorne | 180/294 |
| 3,462,949 | A * | 8/1969 | Anderson et al. | 60/796 |
| 3,550,713 | A * | 12/1970 | Day et al. | 180/294 |
| 3,714,449 | A * | 1/1973 | De Bella | 290/1 C |
| 3,882,951 | A * | 5/1975 | Conley | 180/294 |
| 4,071,009 | A * | 1/1978 | Kraina | 123/198 E |
| 4,629,031 | A * | 12/1986 | Kato et al. | 181/204 |
| 5,868,712 | A * | 2/1999 | Briggs et al. | 604/153 |
| 6,810,989 | B1 * | 11/2004 | Dantlgraber et al. | 181/202 |
| 7,861,822 | B2 * | 1/2011 | Redmann | 181/204 |
| 2011/0187772 | A1 * | 8/2011 | Tomoguchi et al. | 347/7 |
| 2013/0032540 | A1 * | 2/2013 | Acernese et al. | 210/652 |

FOREIGN PATENT DOCUMENTS

| | | |
|---|---|---|
| DE | 7908625 U1 | 7/1979 |
| GB | 2075643 A | 11/1981 |

OTHER PUBLICATIONS

International Search Report.
International Preliminary Report on Patentability.

* cited by examiner

*Primary Examiner* — David Warren
*Assistant Examiner* — Christina Russell
(74) *Attorney, Agent, or Firm* — Roylance, Abrams, Berdo & Goodman, L.L.P.

(57) ABSTRACT

Sound-damping housing for a pump and for a drive motor for said pump, comprising a block-like casing assembled from sound-damping panels and provided with a support construction and a first door opening for successively placing into and removing from the casing the pump and its drive motor on the support construction, and with at least one guide extending over the support construction transversely of the door opening for the purpose of guiding a pump and its drive motor to be placed in the casing.

7 Claims, 4 Drawing Sheets

SOUND-DAMPING HOUSING FOR A PUMP AND FOR A DRIVE MOTOR FOR SAID PUMP

The invention relates to a sound-damping housing for a pump and for a drive motor for this pump, comprising a block-like casing assembled from sound-damping panels and provided with a support construction and a first door opening for successively placing into and removing from the casing the pump and its drive motor on the support construction.

Such a housing is known for encasing a combination of a liquid pump, for instance a plunger pump or centrifugal pump for pumping water, and a diesel engine for driving this pump.

A water pump driven by a diesel engine is for instance applied for the purpose of pumping up groundwater at locations where a connection to the public water main is not available, or at building sites for the purpose of keeping this building site dry. In order to prevent unauthorized persons gaining access to the combination of diesel engine and water pump, or in order to damp the sound generated by this combination, the combination of diesel engine and water pump is often accommodated in a housing.

The placing in and later removal from a housing of a combination of a known diesel engine and such a water pump, for instance for the purpose of maintenance or repair, is a labour-intensive operation. The problem may moreover occur that the combination in a housing is difficult to access for maintenance and for changing oil in the oil sump of the diesel engine, since the housing impedes rapid uncoupling of diesel engine and water pump that is necessary for the maintenance. This problem is further exacerbated by the fact that an above stated combination must usually be in continuous operation, as a result of which the intervals between servicing are relatively short and maintenance must consequently be carried out relatively frequently.

SUMMARY OF THE INVENTION

It is an object of the invention to provide a housing in which the combination of a water pump and a diesel engine can be placed in simple and rapid manner, and in which a placed combination is readily accessible for maintenance, changing oil and possible repair operations.

These objectives are achieved, and other advantages gained, with a housing of the type stated in the preamble which is provided according to the invention with at least one guide extending over the support construction transversely of the door opening for the purpose of guiding a pump and its drive motor to be placed in the casing.

In a housing according to the invention a combination of a pump and its drive motor is placed partially through the door opening into the casing and, guided by the at least one guide, pushed further inward.

In an embodiment of a housing according to the invention the at least one guide co-acts with a carriage which is adapted to bear the pump and its drive motor.

In a practical advantageous embodiment the housing is provided with two guides which extend parallel over the support construction and which each co-act with a corresponding longitudinal carrier of a carriage which is provided with two longitudinal carriers and which is adapted to bear the pump and its drive motor.

A housing according to the invention is preferably adapted for successively placing in and removing from the casing the pump and its drive motor via the door opening using a forklift truck.

An embodiment of this latter housing, which is provided with two guides extending parallel over the support construction, has the feature that the guides are arranged at a mutual distance such that the tines of the fork of a forklift truck fit, within determined limits, precisely along the sides of these guides directed towards each other or along the sides thereof remote from each other.

In an embodiment of such a housing, which is particularly suitable for a combination of a pump and its drive motor placed on a carriage, wherein the longitudinal carriers of the carriage are provided by tubular profiles for receiving therein the respective tines of the fork of a forklift truck, the guides are arranged at a mutual distance such that the tubular profiles fit along the sides of these guides directed towards each other or along the sides thereof remote from each other.

The guides in a housing according to the invention can be manufactured from any suitable bar or profile material.

In an advantageous embodiment the guides have in cross-section an L-shape or an L-shape in mirror image, wherein the guides are placed at a mutual distance such that the longitudinal carriers of a carriage slid into the casing are bounded precisely by the upright legs of the L-shapes.

The advantages of a housing according to the invention become further manifest when this housing comprises a bottom compartment located under the support construction for accommodating a fuel reservoir therein.

The bottom compartment in this latter embodiment preferably comprises a liquid reservoir for collecting waste liquid, and provided on the support construction is a receptacle which is provided with an outlet debouching above an inlet of the liquid reservoir.

This receptacle is more preferably provided on a carriage which is adapted to bear the pump and its drive motor.

In an embodiment of a sound-damping housing according to the invention, wherein for the purpose of further sound reduction the motor is accommodated in a closable motor compartment provided with a door opening, the housing is provided with a second door opening which, via the closable door opening in the motor compartment, provides access to the motor.

BRIEF DESCRIPTION OF THE DRAWINGS

The invention will be elucidated hereinbelow on the basis of an exemplary embodiment and with reference to the drawings.

In the drawings

DETAILED DESCRIPTION OF EXEMPLARY EMBODIMENTS

Figure 1:
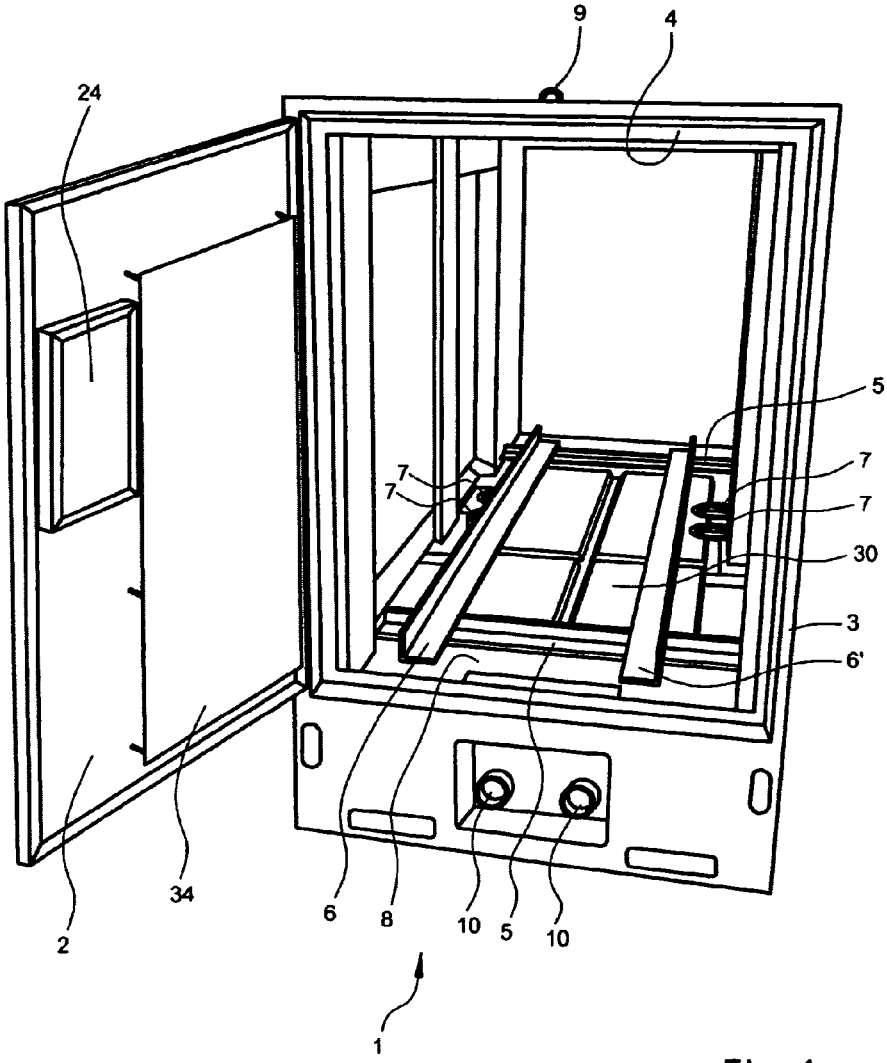
FIG. 1 shows a perspective view of an embodiment of a housing according to the invention in empty state with opened doors.

Corresponding components are designated in the figures with the same reference numerals.

FIG. 1 shows an opened, empty, block-like casing 1 for a combination of a plunger pump and diesel engine (shown in FIG. 2), assembled from sound-damping panels 2, 3, of which a panel 2 forms the door for a first door opening 4 (on the front side in the shown figure). Door opening 4 reveals two L-profiles 5 which together form a support construction over which two L-shaped guides 6, 6' extend in a direction transversely of door opening 4. Support construction 5 bounds a bottom compartment in which a plastic fuel tank 30 and a waste liquid reservoir (not shown) are arranged. Present in fuel tank 30 are closable openings 7 for throughfeed as required of fuel transport conduits, while between support construction 5 and the front door opening 4 an open area 8 is present for throughfeed of an outlet for waste liquid above an inlet of the waste liquid reservoir. A hoisting eye 9 is arranged on the top side of casing 1, outlets 10 of the waste liquid reservoir are present on the underside. Arranged in door panel 2 are an opening 24 for throughfeed of a water inlet conduit (shown in FIG. 2) and an air inlet channel (shown in FIG. 4), the door panel being provided with a sound-damping cover 34.

Figure 2:
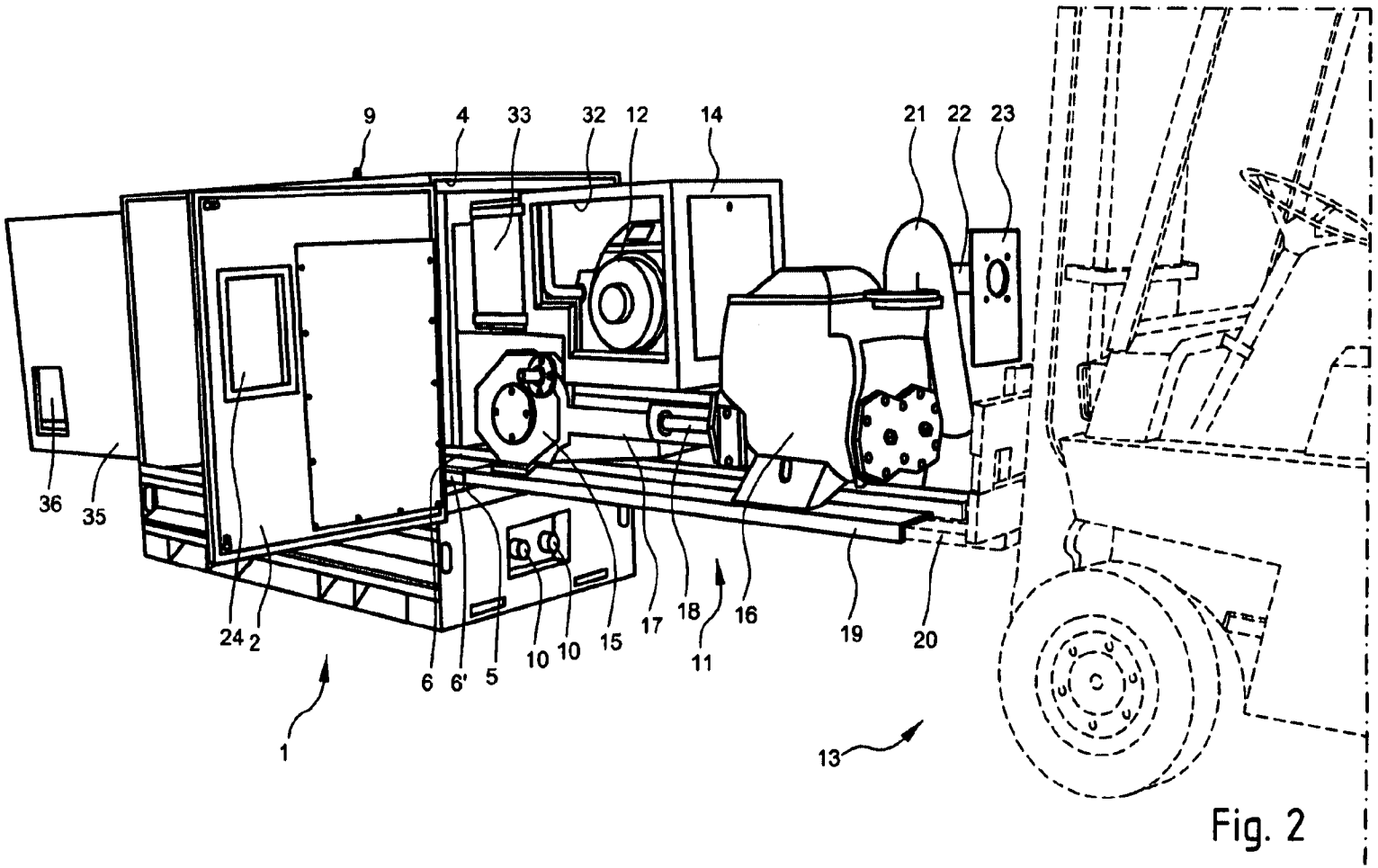
FIG. 2 is a perspective view of the housing shown in FIG. 1 in a situation where a combination of water pump and diesel engine is placed in the housing a forklift truck.

FIG. 2 shows casing 1 of FIG. 1 in a situation where a combination of a plunger pump 11 and a diesel engine 12 is placed in casing 1 using a forklift truck 13. Diesel engine 12 is placed in its own housing 14 between drive part 15 and pump housing 16 on an intermediate part 17 in which a part of a piston rod 18 can be seen through an opening. Diesel engine 12 is accessible via a door opening 32 which is closable with a door 33. The combination of plunger pump 11 and diesel engine 12 is placed on a carriage, the most important part of which is formed by two tubular beams 19 into which the tines 20 of forklift truck 13 fit. The figure also shows a rear door panel 35 for closing the rear side of casing 1, a water outlet 21 mounted on pump housing 16 and a water inlet 22 provided with a sound-damping end plate 23 corresponding with inlet opening 24 in door panel 2. An opening 36 is arranged in door panel 35 for throughfeed of water outlet conduit 21.

Figure 3:
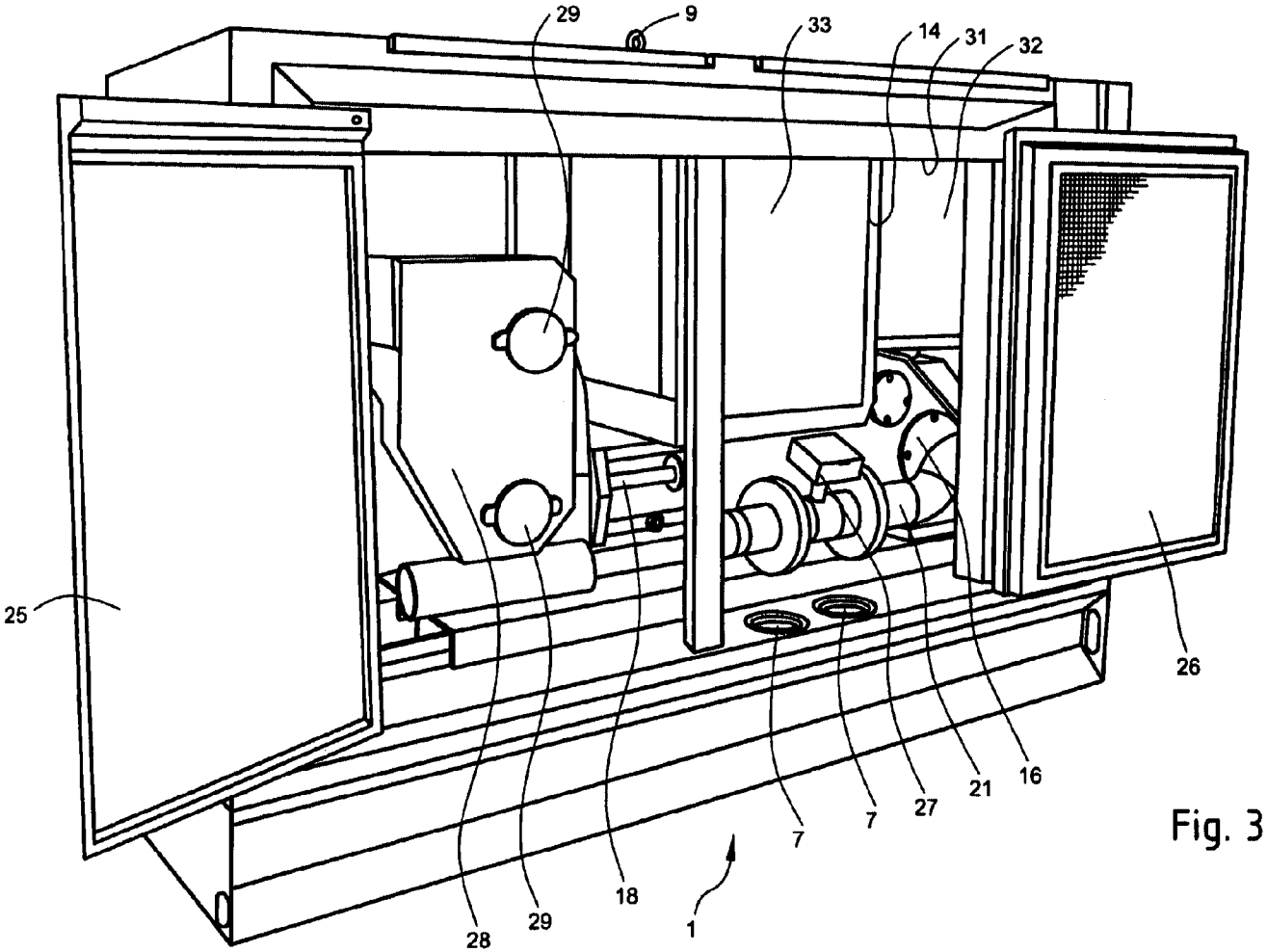
FIG. 3 is a perspective side view of the housing shown in FIG. 1 with opened side door, in a situation where a combination of water pump and diesel engine is placed in the housing.

FIG. 3 shows casing 1 of FIG. 1 having placed therein the combination of a plunger pump 11 and a diesel engine 12 in housing 14. In addition to the above stated components, the figure shows two side panels 25, 26, a liquid flow meter 27 in outlet conduit 21 and a gravel collector 28 with service openings 29 for catching and removing gravel and other solid contaminants in the water supplied through the inlet conduit. Using side panels 25, 26 a second door opening 31 can be closed which, via the closable door opening 32 in motor compartment 14, provides access to the engine.

Figure 4:
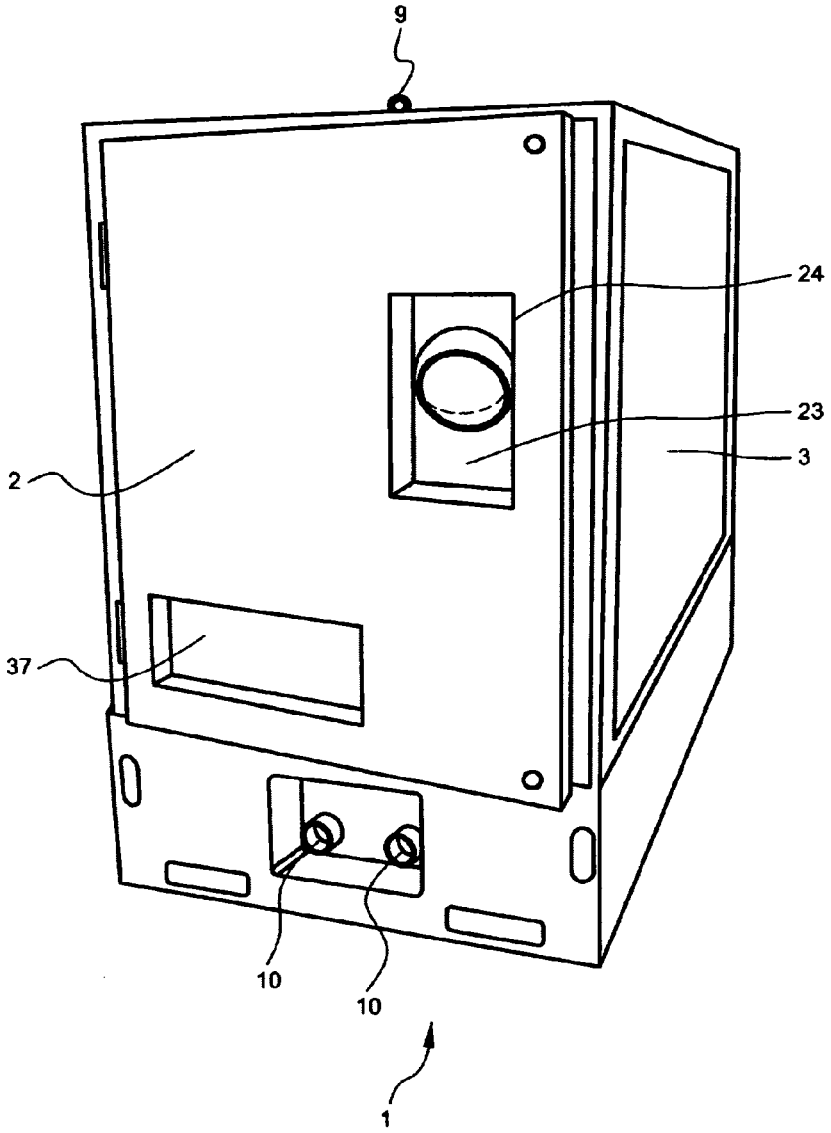
FIG. 4 is a perspective view of the housing shown in FIG. 1 in almost closed position, with a view of the side provided with a connection for an inlet conduit.

FIG. 4 shows casing 1 in almost closed position, with door panel 2 provided with air inlet channel 37, and side panel 3.

The invention claimed is:

1. A sound-damping housing for a pump and a drive motor for said pump, comprising:

a casing having a plurality of sides defining a space therein;

a plurality of sound-damping panels disposed on one or more of said sides of said casing;

a support device disposed within said space supporting the pump and the drive motor;

a first door opening disposed in one of said sides and providing access to said space for successively placing into and removing from said space, the pump and the drive motor;

a carriage carrying said pump and said drive motor; and at least one guide co-acting with said carriage and disposed on top of said support device transverse to said first door, wherein the pump and the drive motor carried on said carriage are guided into said space of the casing and supported on said support device by said carriage and said guide, wherein said carriage includes two longitudinal carriers and said guide includes two guide rails that extend parallel over said support device and which each co-act with a corresponding longitudinal carrier of said carriage and said longitudinal carriers correspond to respective tines of a forklift truck so said forklift truck can lift and place said pump and drive motor on said carriage into said casing.

2. A housing as claimed in claim 1, wherein the longitudinal carriers of said carriage have tubular profiles for receiving therein the respective tines of said forklift truck and said guides rails are arranged at a mutual distance such that the tubular profiles of the longitudinal carriers fit along the sides of said guide rails directed towards each other or along the sides thereof remote from each other.

3. A housing as claimed in claim 2, wherein said guide rails have in cross-section an L-shape or an L-shape in mirror image and are placed at a mutual distance such that the longitudinal carriers of said carriage slide into the casing on said guide rails and are bounded by upright legs of the L-shapes.

4. A housing as claimed in claim 3, further comprising a bottom compartment located under said support device for accommodating a fuel reservoir therein.

5. A housing as claimed in claim 4, wherein said bottom compartment includes a liquid reservoir for collecting waste liquid, and a receptacle is disposed above said support device having an outlet debouching above an inlet of said liquid reservoir.

6. A housing as claimed in claim 5, wherein said receptacle is provided on said carriage.

7. A housing as claimed in claim 6, further comprising a second door opening, wherein the motor is accommodated in a closable motor compartment having a compartment door opening and the motor can be accessed within said closable motor compartment via said second door opening and said compartment door opening.

* * * * *

UNITED STATES PATENT AND TRADEMARK OFFICE

CERTIFICATE OF CORRECTION

PATENT NO. : 8,727,068 B2
APPLICATION NO. : 12/668273
DATED : May 20, 2014
INVENTOR(S) : Johannes Bruin It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1135 days.

Signed and Sealed this
Twenty-ninth Day of September, 2015

Michelle K. Lee

Michelle K. Lee
*Director of the United States Patent and Trademark Office*